United States Patent [19]

Prinzwald et al.

[11] Patent Number: 4,668,113

[45] Date of Patent: May 26, 1987

[54] PRINTING DISC WITH DAMPING MEANS

[75] Inventors: Dieter Prinzwald, Wilhelmshaven; Herbert Budde, deceased, late of Bockhorn, by Inge Budde, legal representative; Johann Heusel, Varel, all of Fed. Rep. of Germany

[73] Assignee: Olympia Werke AG, Wilhelmshaven, Fed. Rep. of Germany

[21] Appl. No.: 729,401

[22] Filed: May 1, 1985

[30] Foreign Application Priority Data

May 5, 1984 [DE] Fed. Rep. of Germany ..... 3416650

[51] Int. Cl.[4] ..... B41J 1/30

[52] U.S. Cl. ..... 400/174; 400/144.2

[58] Field of Search ..... 400/144, 144.1, 144.2, 400/144.3, 144.4, 174, 175; 101/93.18, 93.19

[56] References Cited

U.S. PATENT DOCUMENTS 3,848,722 11/1974 Bolan et al. ..... 400/144.3

3,907,091 9/1975 Meier et al. ..... 400/144.3

FOREIGN PATENT DOCUMENTS 2034366 12/1970 France ..... 400/144.2

1511049 5/1978 United Kingdom ..... 400/174

*Primary Examiner*—Edgar S. Burr

*Assistant Examiner*—David A. Wiecking

*Attorney, Agent, or Firm*—Spencer & Frank

[57] ABSTRACT

In a type disc composed of: a hub; a plurality of spokes extending radially from the hub and spaced apart about the circumference of the hub to form slits between the spokes, each spoke carrying, at its end remote from the hub, a type face arranged to be driven against a record carrier by a printing hammer; and a damping arrangement associated with the spokes for damping vibrations, the arrangement is constituted by a mass of a selected material partially filling each slit and connecting together the spokes adjoining each slit, the material being selected to have a composition which is more elastic than the material of each spoke.

2 Claims, 3 Drawing Figures

PRINTING DISC WITH DAMPING MEANS

BACKGROUND OF THE INVENTION

The present invention relates to printing discs of the type equipped with spokes which are separated from one another and carry type faces at their free ends.

Printing devices composed of a rotatable disc equipped with a plurality of flexible segments carrying type faces and a hammer which causes contact between individual type faces and a document disposed on a platen are very well known in the printing art. Normally, the spokes carrying the type faces are flexible in the striking direction and rather stiff in the direction of rotation. The stiffness in the direction of rotation is necessary primarily for maintaining the correct printing position but also as a protection when the printing disc stops. However, to obtain good print quality, a certain yielding in the direction of movement is appropriate at the moment of impact. Unavoidable vibrations of the spokes in the plane of rotation of the type disc result in fatigue of the material of the spokes carrying the type faces and in breakage of the spokes.

In order to deal with the above-mentioned drawbacks in the type discs presently on the market, the spokes carrying the type faces are connected together by means of a damping ring made of a rubber elastic material. This damping ring is attached to the spokes by means of glue, with the spokes being made, for example, of glass fiber reinforced plastic. Such a configuration of the type discs is very complicated and expensive since an additional processing procedure is required for connecting the damping ring with the spokes.

SUMMARY OF THE INVENTION

It is an object of the present invention to eliminate the danger of breakage of the spokes of a type disc with the simplest means which are inexpensive and suitable for mass production.

The above and other objects are achieved, according to the present invention, in a type disc comprising: a hub; a plurality of spokes extending radially from the hub and spaced apart about the circumference of the hub to form slits between the spokes, each spoke carrying, at its end remote from the hub, a type face arranged to be driven against a record carrier by a printing hammer; and damping means associated with the spokes for damping vibrations, by the improvement wherein the damping means comprise, in each slit, a mass of a selected material partially filling the slit and connecting together the spokes adjoining the slit, the material being selected to have a composition which is more elastic than the material of each spoke.

The type disc according to the invention has the advantage that the damping means which counteract the danger of breakage can be attached to the type disc in an inexpensive manner by means of automatic machinery. For this purpose, a dosaging machine can be used to introduce, for example, the adhesive in the form of drops into the slits between the spokes.

Further advantageous features of the invention will be described below.

DESCRIPTION OF THE PREFERRED EMBODIMENTS

Figure 1:
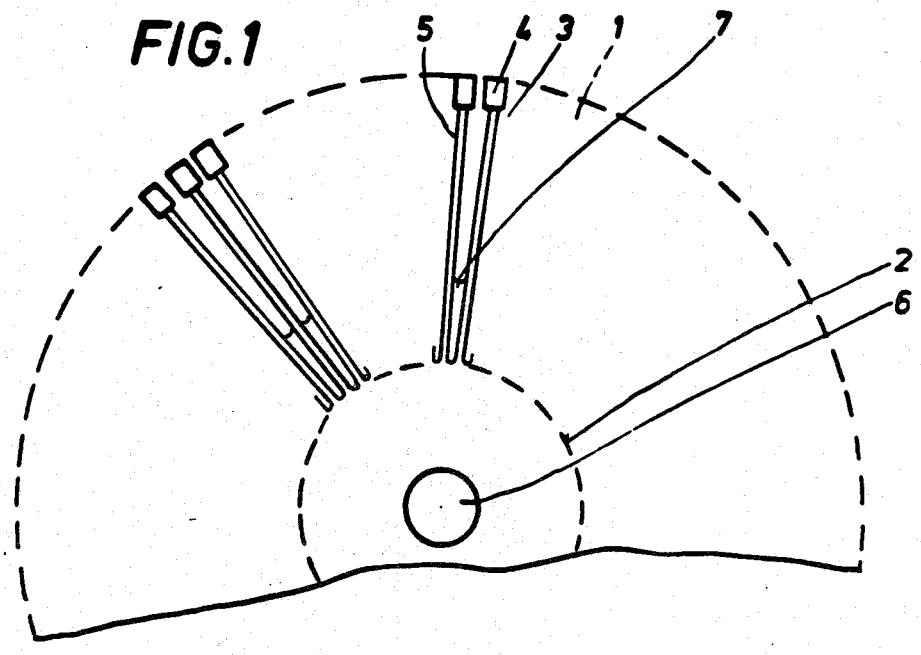
FIG. 1 is an elevational view of a first embodiment of a type disc according to the invention.

FIG. 1 shows a type disc 1 having a hub 2 from which spokes 3 extend radially outwardly. At their free ends, these spokes 3 are equipped with type faces 4 and are separated from one another by slits 5. Each one of the individual slits 5 is rounded at its foot end at hub 2. Type faces 4 can be struck by a printing hammer (not shown) to produce an imprint. Type disc 1 has a receiving bore 6 in hub 2 by means of which type disc 1 can be placed onto a drive shaft in the printer.

Since, during the printing process, spokes 3 carrying type faces 4 are under great stress at their points of connection with hub 2, mutually adjacent spokes 3 are connected together, in addition to by means of hub 2, by means of an elastic mass 7 which fills part of each slit 5. This mass 7 may be much more elastic than the material of spokes 3 which, for reasons of stability and in order to produce a clean print, must be made of a harder material. In this way, it is possible to attain very good damping of spokes 3, particularly in the plane of rotation of disc 1, so that the danger of breakage is likewise counteracted very well.

The elastic mass 7 may be an elastic plastic or an adhesive which remains elastic, such as, for example, a product sold under the trade name Kövulfix, and made by Chemische Fabrik KG Kömmerling, Federal Republic of Germany.

Figure 2:
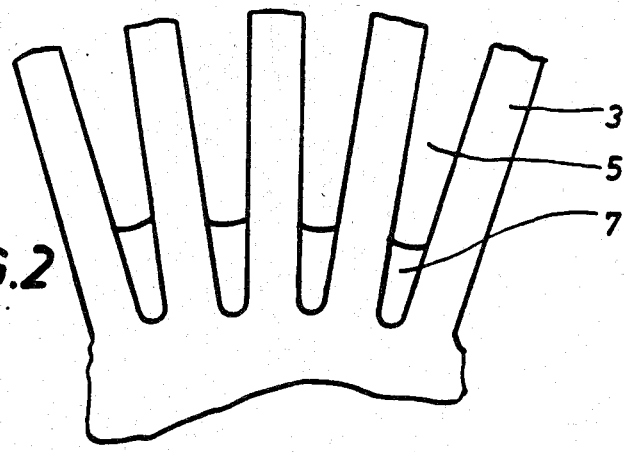
FIG. 2 is a detail view of a portion of the disc of FIG. 1 to a larger scale.

According to FIG. 2, the elastic mass 7 is inserted into slits 5 only at their base, which can advantageously be effected by means of automatic dosaging machines.

Figure 3:
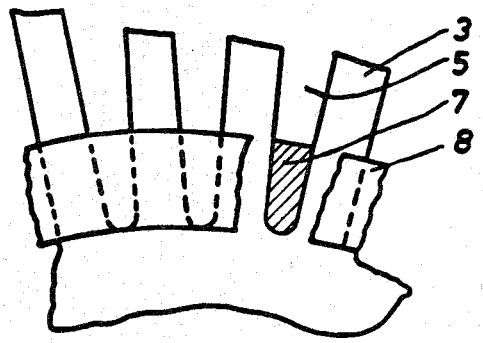
FIG. 3 is a detail view, similar to that of FIG. 2, of a modified type disc according to the invention.

Within the scope of the present invention, and as shown in FIG. 3, the elastic mass 7 to be introduced into slits 5 may also be connected to a circumferential ring 8. In this case, the discharge nozzle of the dosaging device and type disc 1 need perform only one full revolution, without stopping, relative to one another during the application of the elastic mass. An automatic dosaging machine having a ring nozzle can also be used, so that ring 8 and elastic masses 7 can be produced in one process phase, without any relative rotation.

In order to avoid the creation of the above-mentioned ring 8, it is necessary for the discharge nozzle of the dosaging device to be moved in steps in the direction of disc rotation to the front of the individual slits between spokes 3 and to be stopped there. In each stopped position of type disc 1, a precisely measured quantity of the elastic mass is expelled from the discharge nozzle of the dosaging device and is introduced into the free space at the base of each individual slit. This can be done automatically and inexpensively by the dosaging device. Likewise, a separate nozzle may be provided for each slit 5 to introduce an adhesive into that particular slit.

The type discs according to the present invention are provided with damping means which counteract a fast break, which can be applied easily and inexpensively and are made, independently of the material of the spokes 3, of an elastic mass 7 which is very effective with respect to damping.

The length of the mass 7 amount to one third of the length of the slits. Furthermore the mass 7 is as thick as the thickness of each spoke. Also the mass 7 may be more elastic than the material of the spokes. There are many dosaging devices on the market. One of them is the DELOMAT 910 of the firm Delo Kunststoffchemie GmbH, 8032 Müchen-Gräfelfing.

It will be understood that the above description of the present invention is susceptible to various modifications, changes and adaptations, and the same are intended to be comprehended within the meaning and range of equivalents of the appended claims.

What is claimed is:

1. In a type disc comprising: a hub; a plurality of spokes extending radially from said hub and spaced apart about the circumference of said hub to form slits between said spokes, each said spoke carrying, at its end remote from said hub, a type face arranged to be driven against a record carrier by a printing hammer; and vibration damping means, the improvement wherein said damping means consist of said spokes and, in each said slit, a mass of an elastic adhesive material partially filling said slit, confined to said slit, having a thickness no greater than the thickness of said spokes, and connecting together said spokes adjoining said slit, said material being selected to have a composition which is more elastic than the material of each said spoke.

2. Type disc as defined in claim 1 wherein each said mass fills the base area of its respective slit.

* * * * *